US009826837B2

(12) United States Patent
Chen

(10) Patent No.: US 9,826,837 B2
(45) Date of Patent: Nov. 28, 2017

(54) SEAT BACK RECLINER

(71) Applicant: Jui-Lin Chen, Tainan (TW)

(72) Inventor: Jui-Lin Chen, Tainan (TW)

( * ) Notice: Subject to any disclaimer, the term of this patent is extended or adjusted under 35 U.S.C. 154(b) by 0 days.

(21) Appl. No.: 15/142,383

(22) Filed: Apr. 29, 2016

(65) Prior Publication Data

US 2017/0027322 A1 Feb. 2, 2017

(30) Foreign Application Priority Data

Jul. 30, 2015 (CN) ..... 2015 2 0561486 U

(51) Int. Cl.
*A47C 1/032* (2006.01)
*A47C 1/036* (2006.01)

(52) U.S. Cl.
CPC ..... *A47C 1/03216* (2013.01); *A47C 1/036* (2013.01); *A47C 1/03255* (2013.01)

(58) Field of Classification Search
CPC . A47C 1/03216; A47C 1/03255; A47C 1/036; A47C 1/03205; A47C 1/03283
See application file for complete search history.

(56) References Cited

U.S. PATENT DOCUMENTS 3,989,297 A * 11/1976 Kerstholt ..... A47C 1/022 297/300.3
4,432,582 A * 2/1984 Wiesmann ..... A47C 1/03216 297/300.3
4,662,680 A * 5/1987 Dauphin ..... A47C 1/03255 297/300.3
5,004,214 A * 4/1991 Marchina ..... A47C 1/03216 188/300
5,213,395 A * 5/1993 Korteweg ..... A47C 1/022 297/328
6,116,686 A * 9/2000 Luo ..... A47C 31/126 297/286
6,402,232 B1 * 6/2002 Tsai ..... A47C 1/0342 297/68
6,578,918 B1 * 6/2003 Rinne ..... A47C 7/022 297/312

* cited by examiner

*Primary Examiner* — Philip F Gabler
(74) *Attorney, Agent, or Firm* — Rosenberg, Klein & Lee

(57) ABSTRACT

A seat back recliner is revealed. A seat back is pivotally connected to and positioned on a rear end of a seat part of a chair while a cylinder is disposed between the seat part and the seat back. A reclined angle of the seat back is adjustable under control of the cylinder. Thereby a user sitting on the chair can directly adjust the seat back to the reclined angle required. The reclined seat back allows a user to lie back and have the greatest level of comfort and relaxation while sitting on the chair.

4 Claims, 9 Drawing Sheets

SEAT BACK RECLINER

BACKGROUND OF THE INVENTION

Field of the Invention

The present invention relates to a seat back recliner, especially to a seat back recliner that allows a user to adjust a seat back of a chair to the reclined angle required and gives comfort to the user's back while sitting on the chair. The seat back recliner provides greater comfort to a user.

Descriptions of Related Art

Due to rapid economic growth, people become healthy and their purchasing power is increased. Thus people start to buy various tools for a more comfortable and convenient living. A chair is one of their daily essentials. In early days, chairs are used to sit on. With improvement of material life and evolution of industrial technology, the chairs are modified to have difference designs and functions according to a user's requirements. The chairs with an ergonomic design give a user better comfort.

Although various chairs available now only offer better comfort and better posture, they have limits on easy adjustment of the reclined angle of the seat back for great comfort.

Thus there is room for improvement and a need to provide a seat back recliner that overcomes shortcomings mentioned above.

SUMMARY OF THE INVENTION

Therefore it is a primary object of the present invention to provide a seat back recliner that allows a user sitting on a chair to adjust a reclined angle of a seat back directly and gives comfort to the user's back. Thus the seat back tilted provides additional comfort to the user sitting on the chair.

In order to achieve the above object, a seat back recliner of the present invention includes a chair and a cylinder.

The chair is disposed with a seat part and an assembly unit is arranged at a center of a front end of the seat part while a pivot unit is set on each of two sides of a rear end of the seat part. A seat back is connected to the seat part and including a connection unit arranged at the center of the bottom end thereof. The bottom end of the seat back is set with pivot parts corresponding to the pivot units of the seat part. Thus the seat back and the seat part are positioned by the pivot parts and the pivot units pivotally connected.

A control part is disposed on the front end of the cylinder and an end part of the control part is connected to an assembly member. The assembly member is pivotally connected to the assembly unit of the seat part of the chair. A shaft rod is passed through the assembly member and an outer end of the shaft rod is extended to form a control end located outside the seat part of the chair while a leaning end is formed on an inner end of the shaft rod, located in the assembly member and corresponding to the control part of the cylinder. A connection part is formed on a rear end of the cylinder. The cylinder is pivotally connected to the connection unit of the seat back of the chair by the connection part thereof.

Two auxiliary pivot units corresponding to each other are arranged at two sides of a rear end of the seat part respectively. Two connecting rods are set on two sides of the seat back respectively and corresponding to the auxiliary pivot units of the seat part. The connecting rods are pivotally connected to the auxiliary pivot units respectively.

The cylinder is an oil cylinder.

The cylinder is an air cylinder.

Compared with conventional structure, the present invention features on direct adjustment of the reclined angle of the seat back and more comfort while a user sitting on the chair.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
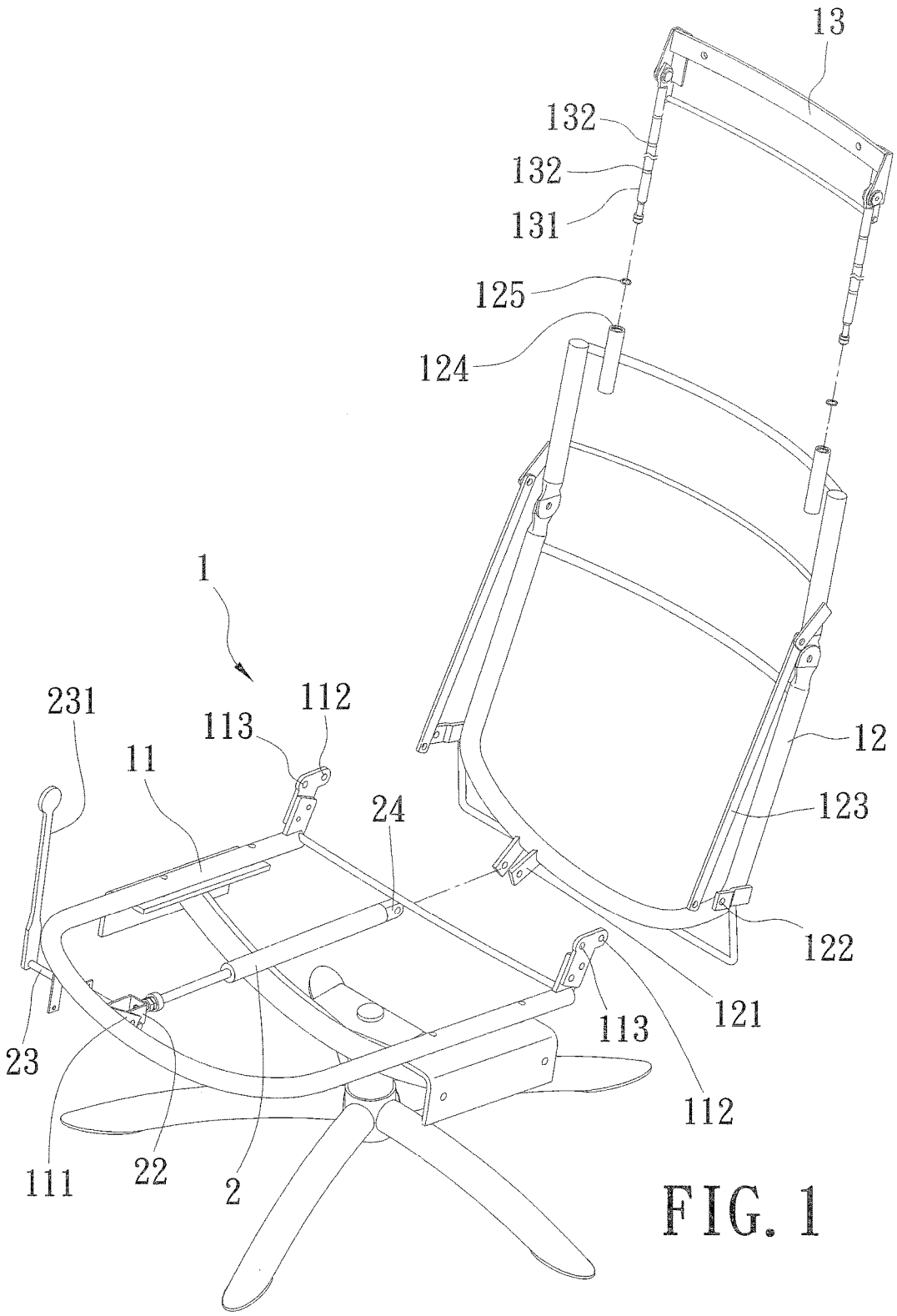
FIG. 1 is an explosive view of an embodiment according to the present invention.
Figure 2:
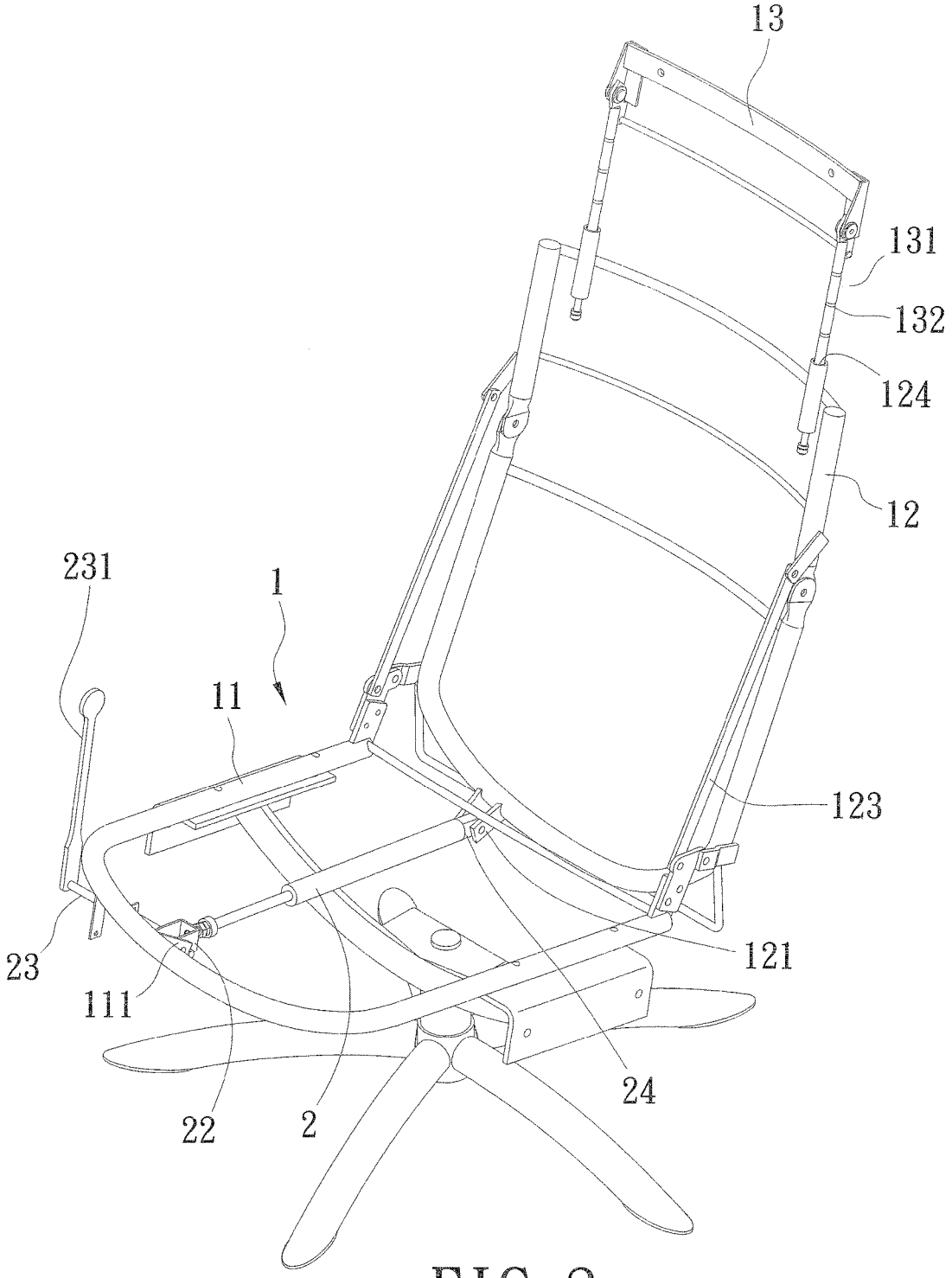
FIG. 2 is a perspective view of an embodiment according to the present invention.

Refer to FIG. 1 and FIG. 2, a seat back recliner of the present invention mainly includes a chair 1 and a cylinder 2.

Figure 3:
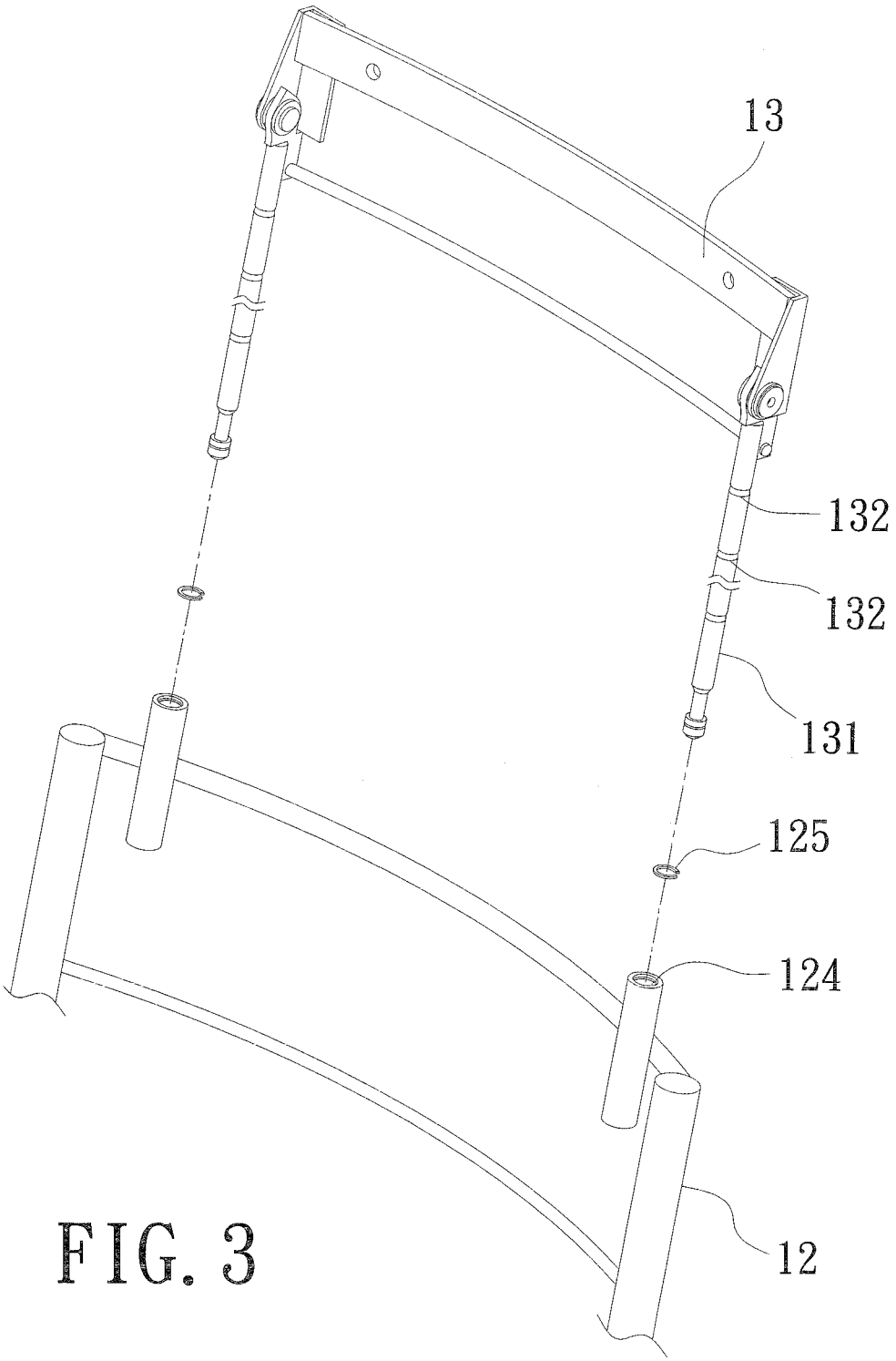
FIG. 3 is an explosive view of a headrest part of an embodiment according to the present invention.

The chair 1 consists of a seat part 11, a seat back 12, and a headrest part 13. An assembly unit 111 is disposed on a center of a front end of the seat part 11 while a pivot unit 112 and an auxiliary pivot unit 113 are arranged at each of two sides of a rear end of the seat part 11. The seat back 12 is connected to the seat part 11 and is composed of a connection unit 121, two pivot parts 122, two connecting rods 123, a pair of insertion holes 124, and two positioning rings 125. The connection unit 121 is arranged at the center of the bottom end of the seat back 12. The pivot parts 122 are set on the bottom end of the seat back 12 and corresponding to the pivot units 112 of the seat part 11. Thus the seat back 12 and the seat part 11 are connected and positioned by the pivot parts 122 and the pivot units 112 pivotally connected. The connecting rods 123 are set on two sides of the seat back 12 and corresponding to the auxiliary pivot units 113 of the seat part 11. The connecting rod 123 is pivotally connected to the auxiliary pivot unit 113 of the seat part 11 for increasing supporting force of the seat back 12. Moreover, refer to FIG. 3, the insertion holes 124 are formed on a top end of the seat back 12 and the positioning ring 125 is fixed in the insertion hole 124. The headrest part 13 is disposed over the seat back 12. Two insertion pins 131 are projecting from the headrest part 13 and corresponding to the insertion holes 124 respectively. A plurality of positioning grooves 132 corresponding to the positioning ring 125 is formed on the insertion pin 131.

Figure 4:
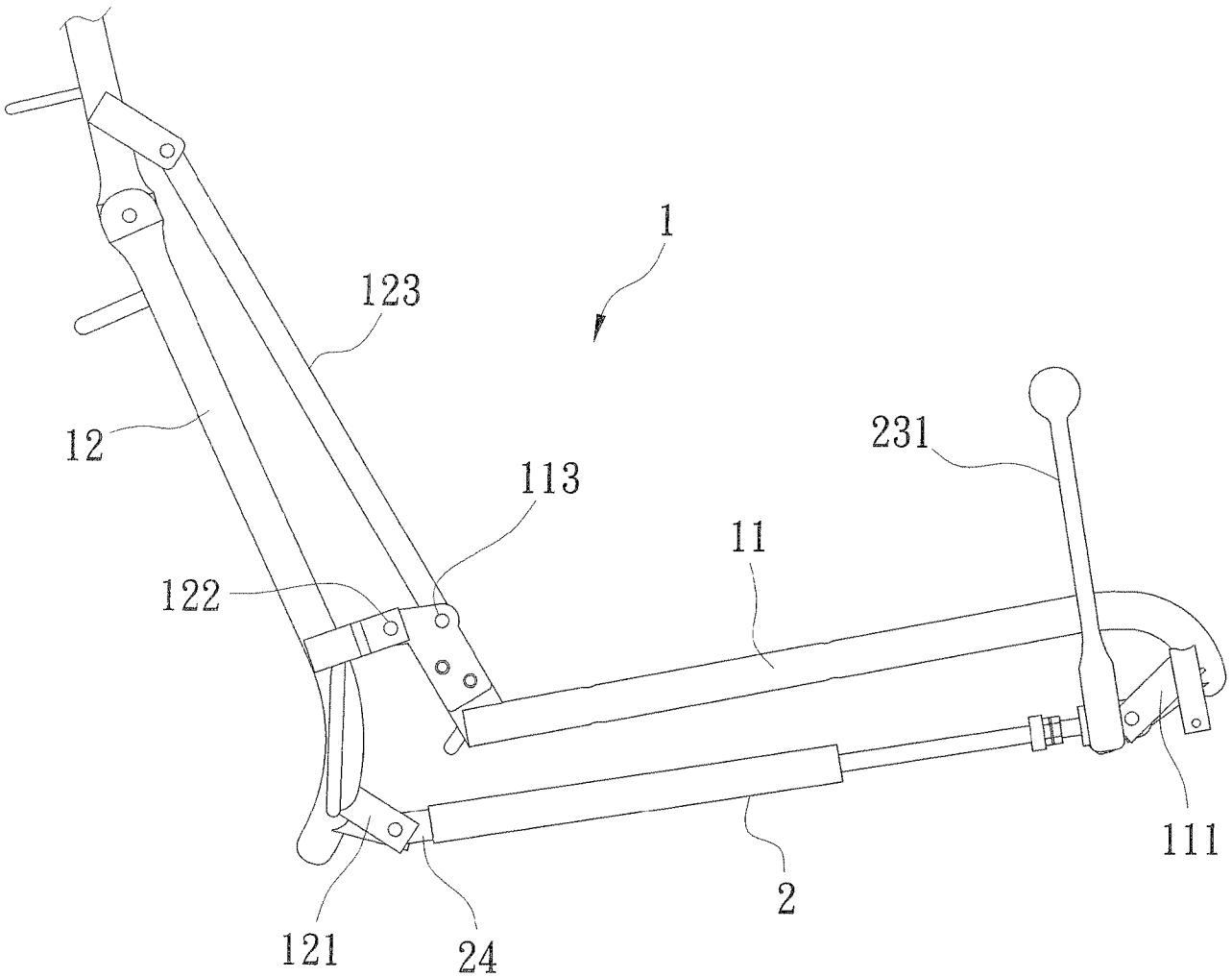
FIG. 4 is a schematic drawing showing a side view of a cylinder being assembled of an embodiment according to the present invention.
Figure 5:
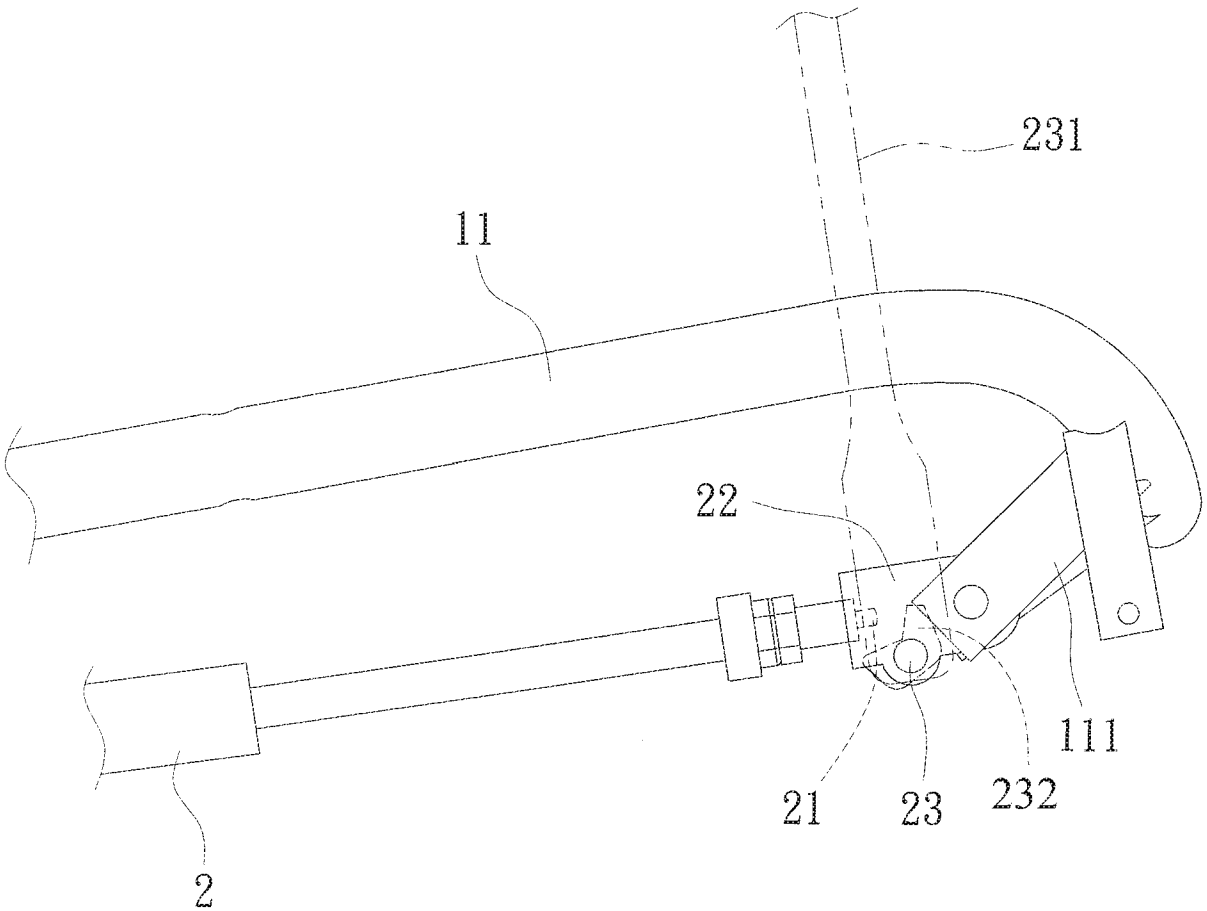
FIG. 5 is a partial enlarged side view of a cylinder being assembled of an embodiment according to the present invention.

The cylinder 2 can be an oil cylinder or an air cylinder. Refer to FIG. 4 and FIG. 5, the cylinder 2 is composed of a control part 21, an assembly member 22, a shaft rod 23, and a connection part 24. The control part 21 is disposed on the front end of the cylinder 2. An end part of the control part 21 is connected to the assembly member 22 while the assembly member 22 is pivotally connected to the assembly unit 111 of the chair 1. The shaft rod 23 is passed through the assembly member 22 and an outer end of the shaft rod 23 is extended to form a control end 231 located outside the seat part 11 of the chair 1 while a leaning end 232 is formed on an inner end of the shaft rod 23, located in the assembly member 22 and corresponding to the control part 21 of the cylinder 2. As to the connection part 24, it is formed on a rear end of the cylinder 2. The cylinder 2 is pivotally connected to the connection unit 121 of the seat back 12 of the chair 1 by the connection part 24.

Figure 6:
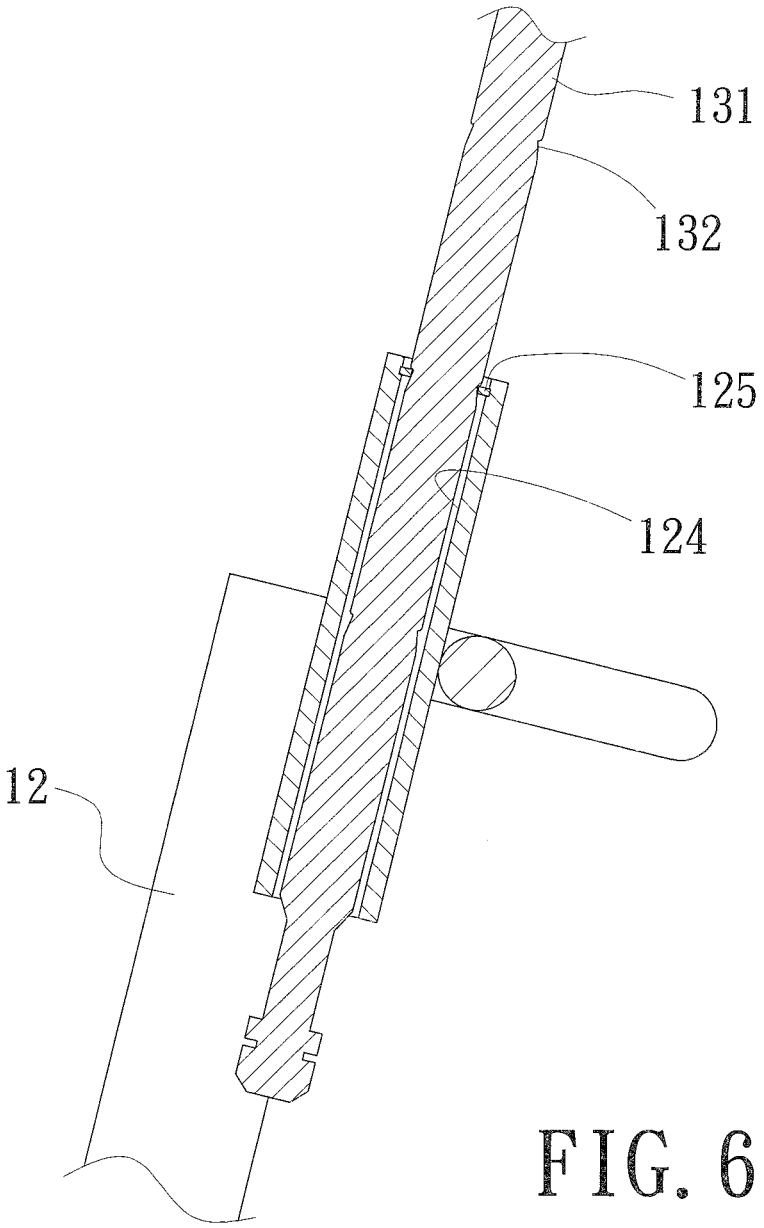
FIG. 6 is a longitudinal cross sectional view of a headrest assembled with a seat back of an embodiment according to the present invention.
Figure 7:
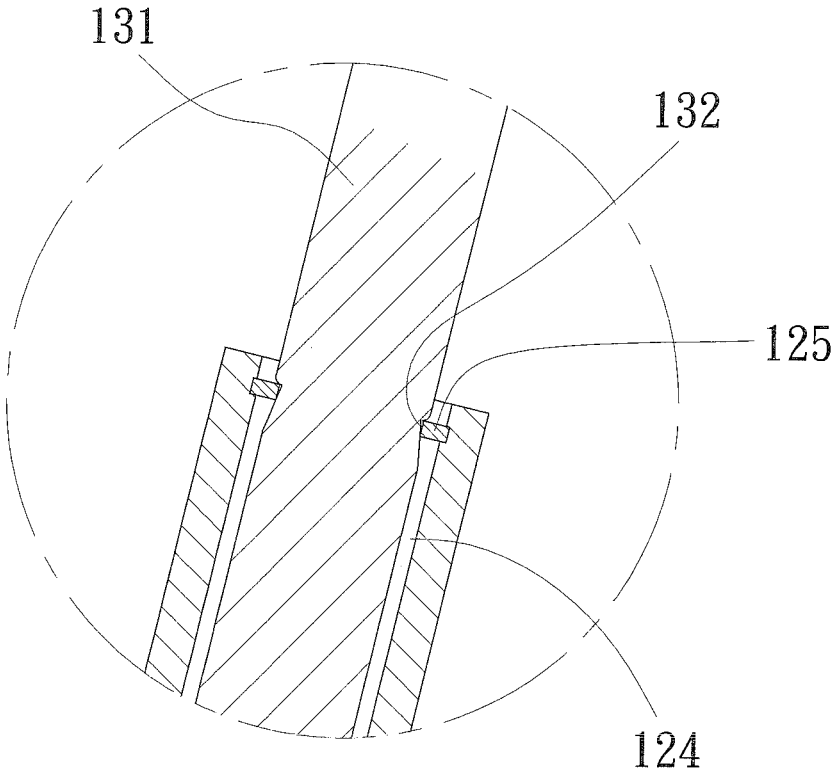
FIG. 7 is a partial enlarged view of a longitudinal cross section of headrest assembled with a seat back of an embodiment according to the present invention.

Also refer to FIG. 6 and FIG. 7, the insertion pin 131 of the headrest part 13 of the chair 1 is mounted into the insertion hole 124 of the seat back 12 correspondingly and is positioned by the positioning ring 125 in the insertion hole 124 being mounted into the positioning groove 132 of the insertion pin 131 correspondingly while in use. Due to the plurality of positioning grooves 132 on the insertion pin 131, the multi-stage adjustment of the height of the headrest part 13 relative to the top end of the seat back 12 is achieved. After adjustment, the insertion pins 131 of the headrest part 13 at the proper height are positioned by the positioning ring 125 in the insertion hole 124 being locked into the positioning groove 132.

Figure 8:
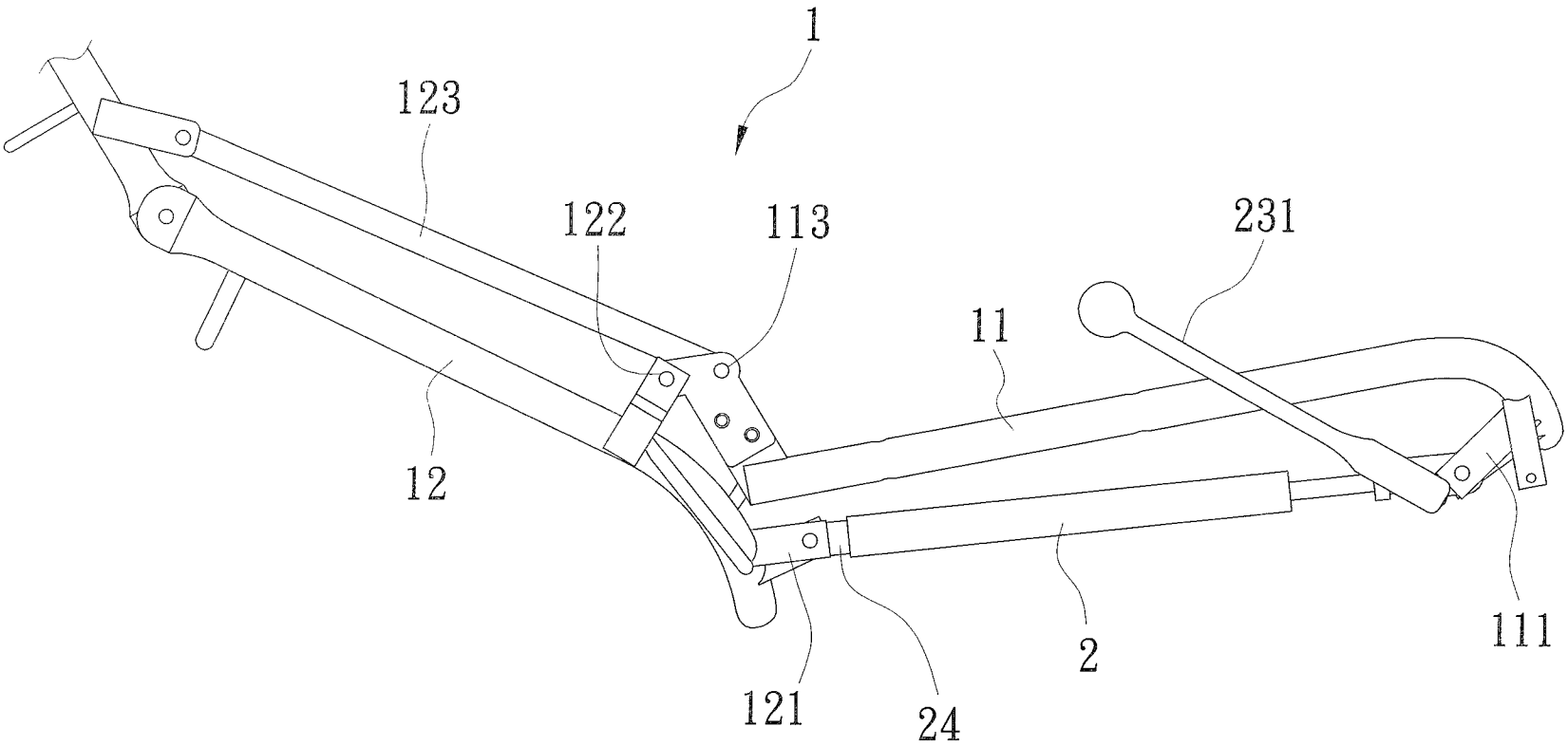
FIG. 8 is a schematic drawing showing a side view of a cylinder in use of an embodiment according to the present invention.
Figure 9:
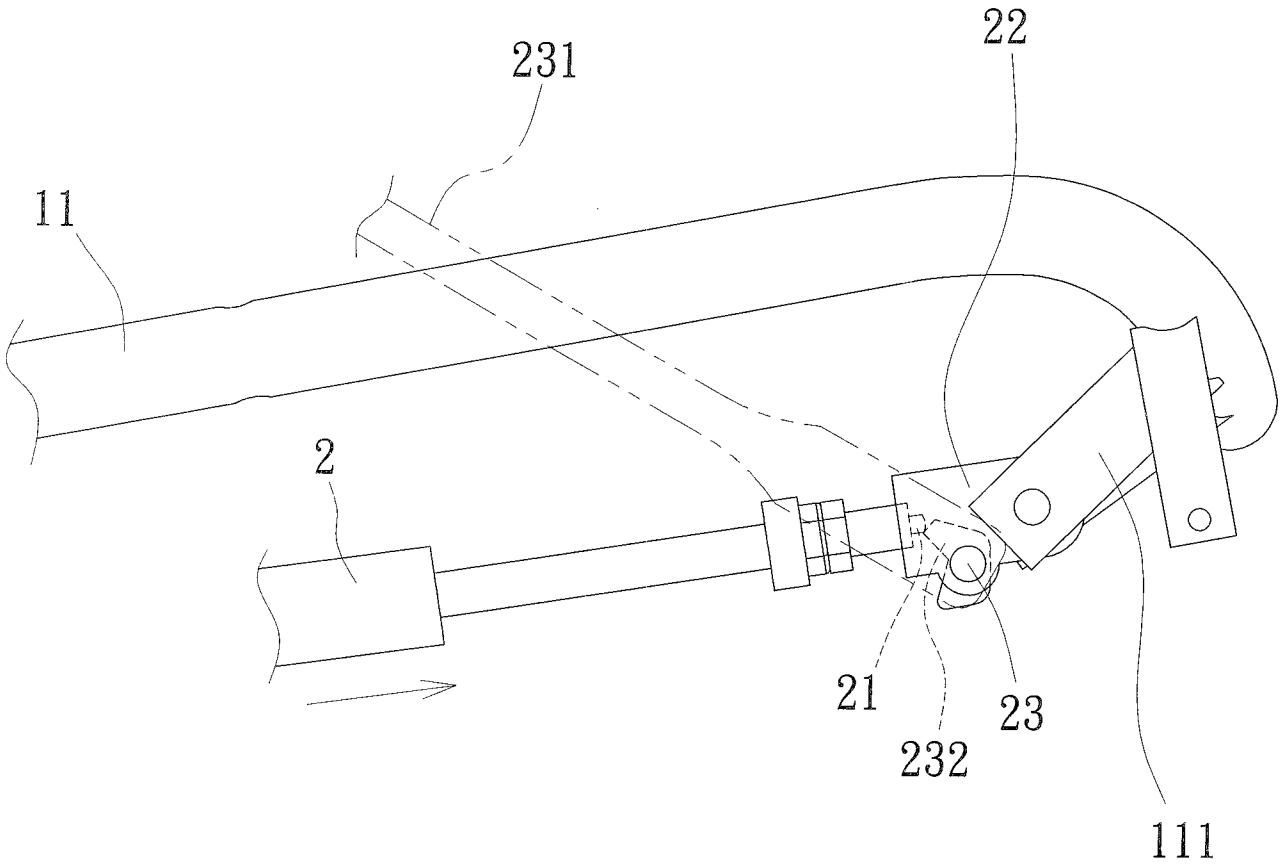
FIG. 9 is a schematic drawing showing a partial enlarged side view of a cylinder in use of an embodiment according to the present invention.

Refer to FIG. 8 and FIG. 9, when a user intends to adjust the reclined angle of the seat back 12 of the chair 1, the control end 231 of the shaft rod 23 is pulled by a user. Then the shaft rod 23 is driven to rotate by the control end 231 so that the leaning end 232 of the shaft rod 23 is pressed against the control part 21 of the cylinder 2. Thus the cylinder 2 is adjustable and the seat back 12 is able to be reclined relative to the rear end of the seat part 11. After completing the adjustment, the control end 231 is pulled again for driving the shaft rod 23 to rotate. Thus the leaning end 232 of the shaft rod 23 is no more pressed against the control part 21 of the cylinder 2. Therefore the cylinder 2 is in the fixed state and the seat back 12 is positioned, unable to be adjusted.

In summary, the seat back recliner of the present invention allows a user sitting on the chair to directly adjust the reclined angle of the seat back compared with the structure available now. The reclined seat back allows a user to lie back and have the greatest level of comfort and relaxation while sitting on the chair.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A seat back recliner comprising:

a chair and a cylinder;

wherein the chair includes a seat part and a seat back connected to the seat part; an assembly unit is arranged at a center of a front end of the seat part with a pivot unit set on each of two sides of a rear end of the seat part; a connection unit is arranged at a center of a bottom end of the seat back and pivot parts corresponding to the pivot units of the seat part are set on the bottom end of the seat back; and the pivot parts are pivotally connected to the pivot units to position the seat back relative to the seat part; a plurality of connecting rods each pivotally connected to both the seat back and the seat part and extending therebetween;

wherein the cylinder is disposed with a control part on a front end thereof connected to an assembly member; the assembly member is pivotally connected to the assembly unit of the seat part of the chair; a shaft rod is passed through the assembly member and an outer end of the shaft rod is extended to form a control end located outside the seat part of the chair with a leaning end formed to extend transversely from an inner end of the shaft rod, the leaning end being located in the assembly member to selectively actuate the control part of the cylinder responsive to rotation of the shaft rod; and a connection part is formed on a rear end of the cylinder pivotally connected to the connection unit of the seat back of the chair.

2. The seat back recliner as claimed in claim 1, wherein two auxiliary pivot units corresponding to each other are arranged at the two sides of the rear end of the seat part respectively; two of the connecting rods are set on two sides of the seat back pivotally connected to the auxiliary pivot units respectively.

3. The seat back recliner as claimed in claim 1, wherein the cylinder is an oil cylinder.

4. The seat back recliner as claimed in claim 1, wherein the cylinder is an air cylinder.

* * * * *